United States Patent [19]

Stafford

[11] 4,364,563

[45] Dec. 21, 1982

[54] ENERGY DISSIPATING BALL TEE

[76] Inventor: David F. Stafford, 3504 N. Dale, Spokane, Wash. 99206

[21] Appl. No.: 248,974

[22] Filed: Mar. 30, 1981

Related U.S. Application Data

[63] Continuation-in-part of Ser. No. 947,951, Oct. 2, 1978, abandoned.

[51] Int. Cl.[3] ..... A63B 69/36; A63B 69/38

[52] U.S. Cl. ..... 273/26 R; 273/29 A; 273/DIG. 4; 273/55 B

[58] Field of Search ..... 273/DIG. 8, DIG. 4, 273/26 R, 209, 186 R, 186 D, 195 R; 36/67 D

[56] References Cited

U.S. PATENT DOCUMENTS

| | | | |
|---|---|---|---|
| 1,670,123 | 5/1928 | Ranseen | 273/209 X |
| 2,652,250 | 9/1953 | Alder et al. | 273/26 R |
| 2,682,714 | 7/1954 | Phillips | 36/67 D |
| 2,934,348 | 4/1960 | Magida | 273/195 R X |
| 3,101,949 | 8/1963 | Williams | 273/186 D |
| 3,113,780 | 12/1963 | Livingstone | 273/186 R |
| 3,236,520 | 2/1966 | Friedman | 273/26 R |
| 3,251,600 | 5/1966 | Warnberg | 273/DIG. 8 |
| 3,554,543 | 1/1971 | Dilaura | 273/DIG. 8 |
| 3,559,998 | 2/1971 | Kelly | 273/212 |
| 3,561,764 | 2/1971 | Thomas | 273/195 R X |
| 3,858,878 | 1/1975 | Tassone | 273/26 R |
| 3,858,879 | 1/1975 | Candor et al. | 206/315 X |
| 4,106,772 | 8/1978 | Krawagna | 273/186 R |

*Primary Examiner*—George J. Marlo

*Attorney, Agent, or Firm*—Wells, St. John & Roberts

[57] ABSTRACT

A ball tee is described for supporting a ball as a stationary target at a prescribed elevation to be struck as a practice exercise for a selected sport. The tee structure is formed with a self-supporting material that is capable of absorbing and dissipating energy delivered by violent impact. It is formed of two interfitting members, a base and a shaft. The shaft has a ball receiving support at an outer end that will hold a ball at a prescribed elevation. The shaft is removable from the base which includes a recess formed in its bottom side. This recess may be utilized to support larger balls adjacent to a ground surface primarily for kicking purposes. In another embodiment, the ball support may be provided with gripping members that releasably support a ball at any selected angle. The shaft is formed of a synthetic closed cell material. The nature of the material is such that it will not significantly disrupt the swing path of a bat or the resultant trajectory of the target ball. Further, recoil shock suffered by the person holding the bat or racket is hardly noticeable. The material dissipates the energy of impact and will recover its original geometry quickly after impact.

17 Claims, 10 Drawing Figures

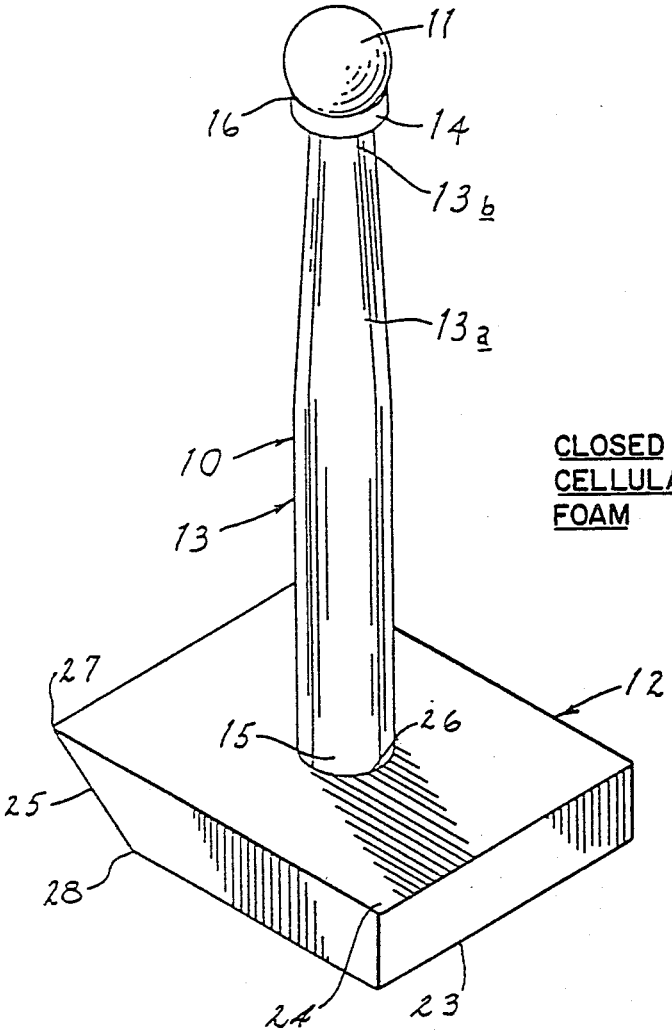
FIG 7
FIG 9
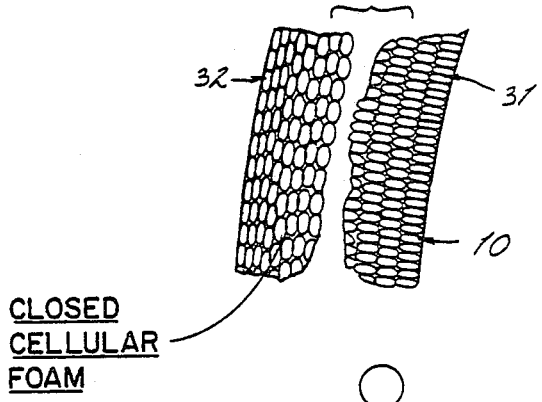
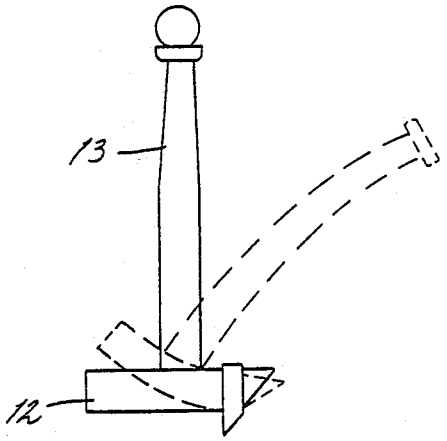
FIG 10
FIG 8
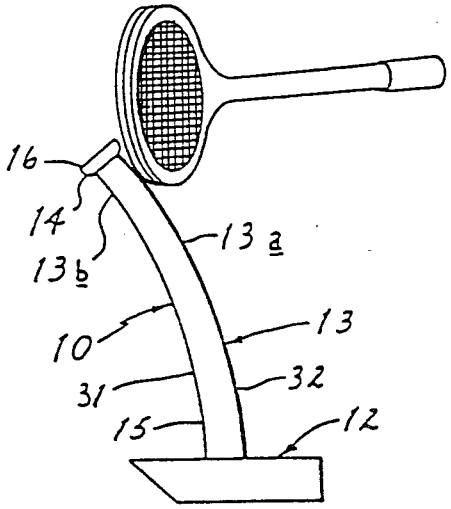

ENERGY DISSIPATING BALL TEE

This is a continuation-in-part application to a patent application filed Oct. 2, 1978 having Ser. No. 947,951, now abandoned.

BACKGROUND OF THE INVENTION

The present invention relates generally to practice tees for supporting a ball at a selected elevation as a target to be struck at by some object such as a bat and more particularly to such tee structures having a flexible recoverable shaft for supporting the ball.

People, especially small children, require a simple tee to support a ball as a stationary target in order to learn a correct bat or a racket swing. Often portions of the tee are impacted instead of, or in addition to, the ball it supports. In tennis, danger of damage to the strings and racket frames has precluded the practical use of prior tees in tennis practice.

Conventional ball support tees are generally formed of a resilient material of high density. When impacted, these tees may either break or recoil with nearly an equal opposite force. Therefore, such tees present a difficult and uncertain safety problem.

BRIEF DESCRIPTION OF THE DRAWINGS

A preferred and alternate form of the present invention is illustrated in the accompanying drawings in which:

FIG. 7 is a pictorial view of an alternate embodiment illustrating a tapered shaft of a tee;

FIG. 8 is a diagrammatic view of the alternate embodiment illustrated in FIG. 7 showing the tee being impacted by a tennis racket.

FIG. 9 is a pictorial view of a fragmentary portion of the cross section of the shaft illustrating closed cellular structure under tension and closed cellular structure under compression; and FIG. 10 is a diagrammatical view similar to FIG. 8 except showing a base of the tee being tethered.

DETAILED DESCRIPTION OF A PREFERRED EMBODIMENT

Figure 1:
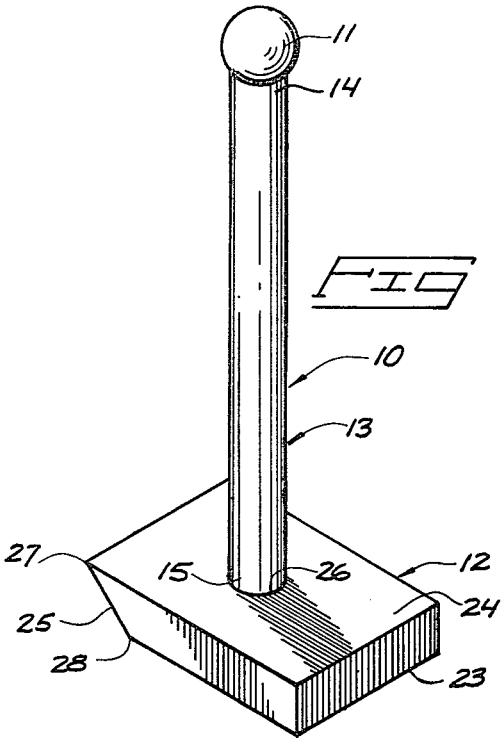
FIG. 1 is a pictorial view of the present tee structure showing a ball mounted thereon.

A tee embodying a preferred form of the invention is illustrated in the accompanying drawings and is designated therein by the reference character 10. The tee 10 is intended to support a ball 11 at a prescribed elevation to be struck at by a bat. The term "bat" as used in this specification is intended as a broad generic term to include all striking instruments used in sporting activities, such as tennis rackets, baseball bats, mallets, paddles, clubs, etc. In fact, it is conceivable that the tee could be utilized for supporting a ball to be swung at by the user's hand for practice in such areas as handball. Therefore, in the context of this application, the human hand and arm may also be considered as falling into the generic domain encompassed by the broad term "bat".

The tee 10 is comprised generally of a base 12 and a shaft 13 which preferably interfit together. When fitted together, the elements 12 and 13 comprise the structure illustrated in FIGS. 1, 2, and 6. As such, the shaft 13 extends outwardly of the base 12 to an outward end 14. An opposite end 15 is fitted to the base 12 in order to provide maximum support. The end 14 includes an integral ball support 16.

In a preferred form, the ball support 16 is comprised of an integral cup configuration 17 formed within the end 14. The cup configuration substantially conforms to the curvature of a standard ball size such as a baseball or tennis ball to provide only enough support to hold the ball stationary at the prescribed elevation.

Figure 4:
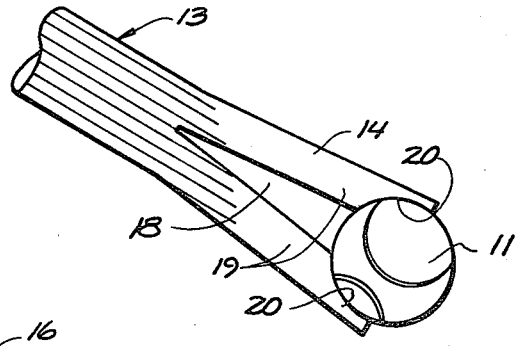
FIG. 4 is a view of an alternate ball support means of my invention.

In an alternate form, the ball support 16 includes an integral slit 18 extending from the end 14 toward the base 12. The slit 18 divides the shaft end 14 into two ball gripping members 19. The nature of the material forming the shaft allows forcible separation of the gripping members 19 to releasably receive a ball 11 as shown in FIG. 4. Opposed concave surfaces 20 of the gripping members 19 conform to the spherical shape of the ball to facilitate reception and to freely release the ball from the grip of the members. Provision of this embodiment enables the ball to be supported at a selected elevation with the shaft 13 at any selected angle relative to the ground surface. For example, the base 12 with this configuration, could be attached to a ceiling structure with the shaft 13 depending therefrom to locate end 14 at a selected elevation, perhaps for the purpose of locating a tennis ball at a selected serving height. In such a situation the gripping members 19 will serve to releasably secure the ball without any direct underlying support. In this embodiment, and where the base is tethered to a board, ball height may be adjusted by means of an extra long shaft which protrudes through a hole in the board. In this case shaft 13 would be secured with a tight but adjustable fit through conical flange 21. Note that flange 21 need not be formed of energy dissipating material in order to maintain the safety integrity of the device, since it is altogether enclosed by energy dissipating material. It could simply be a funnel shaped piece of solid plastic, and, in application where it would never be impacted, it could be permanently attached to the board, eliminating need for the rest of the base.

Figure 2:
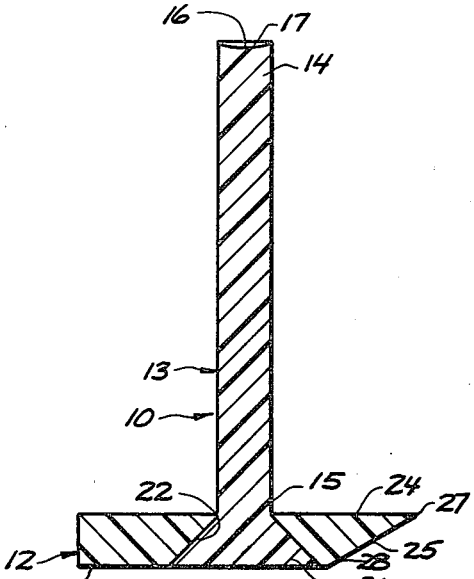
FIG. 2 is a vertical cross-sectional view of the tee.

The end 15 of shaft 13 includes a conical flange 21 (FIG. 2). Flange 21 is releasably received within a complementary conical recess 22 formed in base 12. Recess 22 extends from a bottom surface 23 of base 12 toward a flat top surface 24. An aperture connects the recess 22 with the top surface 24. Aperture 26 is similar in configuration to the cross-sectional shape of shaft 13. A nested fit may thus be achieved as illustrated in FIG. 2 to securely mount the base and shaft together.

Figure 3:
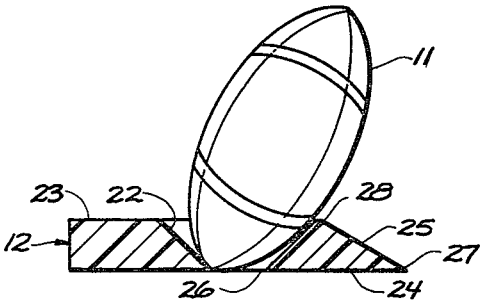
FIG. 3 is a cross-sectional view of the base member alone showing positioning of a football thereon.

When the base 12 and shaft 13 are disassembled, the recess 22 within the base may be utilized as a ball support as shown in FIG. 3. In this situation, the base is inverted with the top surface 24 resting on the ground and the conical recess 22 facing upwardly. A ball is received within the recess and supported in the desired stationary position for kicking purposes. A football is shown in place in FIG. 3. However, it is understood that other forms of balls can be as easily positioned and supported for practice kicking or batting, etc.

An inclined surface 25 is provided to facilitate kicking practice. The surface 25 leads inwardly from an edge 27 along the top surface 24 to an edge 28 adjacent to the conical recess 22 that extends along the bottom surface 23. Inclined surface 25 enables relatively free access to a ball supported within the recess 22 without interference with the swing path of the striking object, whether it be the user's foot or some other form of "bat".

The tee 10 is constructed of a synthetic cellular material 30 with characteristics of non-destructive bending upon impact and dissipating of kinetic energy of a moving impact instrument without damaging either the instrument or the tee. A further characteristic is the material's ability to recover its original geometry after the initial impact.

The density of the material is important to reduce the total weight of the tee, and more importantly, to store only minimal amounts of energy upon impact with the bat. It is preferable that the density of the material, at least the material within the shaft, be less than ten pounds per cubic foot. In an experimental mode, a density of approximately two pounds per cubic foot proved to be very satisfactory.

It follows from collision theory that very little energy is transferred in impact by a heavy projectile upon a much lighter target. Thus, disruption of a bat swing path is minimized upon its engagement with the much less massive tee shaft. Distortion of the swing path and the resultant trajectory of the target ball is minimized and recoil shock suffered by the person wielding the bat is hardly noticeable. Therefore, because of extreme light weight, there is a minimum of energy for the tee to absorb and correspondingly minimum possibility of damage to equipment or injury to persons.

I have found that a closed cell polyethylene foam is preferable as material for the shaft 13. Both the shaft 13 and the base 12 are preferably formed of the same polyethylene foam material. Such material may include a density of two pounds per cubic foot, as utilized in the experimental model, thus giving a total weight of four ounces for a tee having a shaft of two inches in diameter and 18 inches in length and a base of two inch thickness and approximately seven and one-half by nine and one-half inches along the rectangular sides. Such light weight enables very young children to master the tee immediately with ease and delight. Further, the extreme low density in addition to the characteristic softness of the polyethylene foam material make it an inoffensive projectile when improperly struck in an untethered condition.

Figure 6:
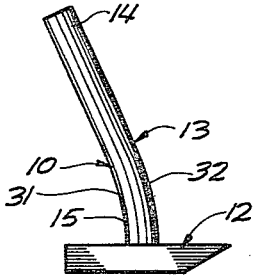
FIG. 6 is a diagrammatic view showing the shaft of the present tee in a temporary bent condition.

FIG. 6 diagrammatically illustrates the condition of shaft 13 when impacted at a point adjacent to the outward end 14. As shown, the shaft will bend in the direction of motion of the impacting object. In doing so, the cellular structure along an inside surface of the bent shaft as shown at 31 will compress while the closed cells along an outside surface 32 will be simultaneously placed under tension. Cell strain varies continuously throughout the volume of material between these surface extremes, so that no portion of the device is stressed to the point of damage or failure. The closed cells of the polyethylene foam material are thus changed in volume. Air contained within the cells is heated due to this change in volume. Much of the relatively little energy that is transferred to the shaft is expended through heat transferred to the air within the individual cells as they change in volume.

The remaining energy stored by the shaft material is utilized to quickly, yet non-violently, move the shaft back to its original geometry or normal straightened condition and uniform cross section. With the polyethylene foam material, the deformed shaft will receive its original geometry promptly as the stress is removed. However, it behaves overall as a critically damped inelastic energy-absorbing oscillator. This is because air has been compressed and slightly heated when the volume of the individual cells decrease during deformation of their normal spherical shape. Impact energy goes directly into heat with recovery being prompt but inelastic. The temperature build-up in such material is insignificant during the intended intermittent use.

The tee will tumble when forcibly impacted by a bat. Small children enjoy the ordering exercise of righting it and arranging the ball for the next attempted hit. Adults avoid this nuisance by tethering the tee to a board or bench by using a hold down strap (not shown) or belt around the base just forward of the emerging shaft. When the tethered tie is impacted, the base bends as well as the shaft, absorbing energy and recovering in exactly the same manner as the shaft.

Figure 5:
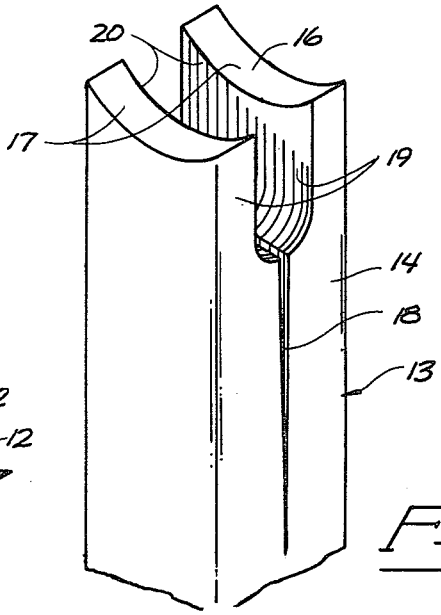
FIG. 5 is an isometric view of the alternate form of support means illustrated in FIG. 4.

It is noted that the shaft illustrated in FIGS. 1 and 2 is cylindrical while the shaft illustrated in FIG. 5 is rectangular in cross section. This is illustrative of two forms the shaft may take in cross section. The particular form utilized may depend on the availability of material in a particular cross-sectional configuration. It is not critical that the shaft be cylindrical or rectangular in cross section but rather that it be of relatively uniform homogeneous density throughout its length and cross section and formed of the appropriate synthetic closed cell material.

An alternate embodiment tee 10 is illustrated in FIGS. 7 and 8. As illustrated, the shaft 13 has a tapered section **13*a* extending downward from the ball support 16. The tapered section 13*a* has a reduced neck portion 13*b* immediately below the ball support.From the reduced neck section the tapered section 13*a* has a progressively increased diameter even though the cross section is homogeneous. The tapered feature enables the shaft 13 to bend more uniformly between the shaft ends 14 and 15 as illustrated in FIG. 8** to dissipate the energy.

It is to be noted that the above description is given by way of example to set forth a preferred and alternate form of my invention. The description is not in any way to be taken as restrictive upon the scope of my invention which is defined only by the following claims.

What I claim is:

1. An energy dissipating ball tee for supporting a ball at a prescribed elevation to be struck at by a swinging bat moving in a selected direction, comprising:

a base member;

an elongated shaft mounted to the base member and projecting therefrom to an outward end;

a ball support integral with the shaft and formed at the outward end of the shaft;

said elongated shaft being formed of a self-supporting low density synthetic closed cell foam material of a defined volume having a homogeneous closed cellular cross section extending along the elongated shaft that serves as a critically damped inelastic energy-absorbing oscillator when the shaft is struck by the swinging bat moving in the selected direction with the shaft nondestructively progressively bending throughout the length of the elongated shaft from the base member to the ball support causing cell strain to vary throughout the cross section with a surface facing opposite the selected direction in maximum tension and a surface facing in the selected direction in maximum compression to distort the closed cells and to inelastically compress and to thereby heat air entrapped within the closed cells to absorb and dissipate the kinetic energy of the impact throughout the volume of the shaft without damaging either the bat or the shaft and to further cause the shaft to unbend to its original geometry without significant rebound.

2. The energy dissipating ball tee as defined by claim 1 wherein the material forming the shaft is low density closed cell polyethylene foam material.

3. The energy dissipating ball tee as defined by claim 1 wherein the ball support includes an integral cup configuration formed in the end of the shaft.

4. The energy dissipating ball tee as defined by claim 3 wherein the ball support includes a slit dividing the outward end of the shaft into two ball gripping members that may be forcibly spread apart to releasably receive a ball.

5. The energy dissipating ball tee as defined by claim 1 wherein the ball support includes a slit dividing the outward end of the shaft into two ball gripping members that may be forcibly spread apart to releasably receive a ball.

6. The energy dissipating ball tee as defined by claim 1 wherein the shaft is removably mounted to the base and includes a conical flange at an end thereof opposite the outward end;

wherein the base includes a flat bottom surface;

wherein the base includes a conical recess complementary to the conical flange on the shaft formed in the bottom surface;

an aperture formed through the base and opening into the conical recess for receiving the shaft; and wherein the conical recess is adapted to receive and support a ball.

7. The energy dissipating ball tee as defined by claim 6 wherein the base includes a flat top surface and an inclined side surface.

8. The energy dissipating ball tee as defined by claim 2 wherein the shaft is approximately two inches in diameter and eighteen inches long from the base to the outward end.

9. The energy dissipating ball tee as defined by claim 1 wherein the shaft has a tapered section adjacent its upper end to enable the shaft to bend more uniformly when it is impacted.

10. The energy dissipating ball tee as defined by claim 1 wherein the material forming the shaft includes a density of less than 10 pounds per cubic foot.

11. An energy dissipating ball tee for supporting a ball at a prescribed elevation to be struck at by a swinging bat moving in a selected direction, comprising:

a base member formed of a low density synthetic closed cellular foam material;

an elongated shaft formed of low density synthetic closed cellular foam material and having a homogeneous closed cellular cross section extending from the base to an outward end;

a ball support integral with the shaft and formed at the outward end of the shaft;

means for securing the base member forward of the elongated shaft to cause both the base and shaft to nondestructively progressively bend between the securing means and the ball support when the shaft is struck by the swinging bat moving in the selected direction causing cell strain to distort the closed cells and to inelastically compress the cells and to thereby heat air entrapped within the closed cells to absorb and dissipate the kinetic energy of the impact in the shaft and base without damaging either the bat, the base or the shaft and to further cause the shaft and base to unbend to its original geometry without significant rebound.

12. The energy dissipating ball tee as defined by claim 11 wherein the material forming the shaft and base is low density closed cell polyethylene foam material.

13. The energy dissipating ball tee as defined by claim 11 wherein the ball support includes an integral cup configuration formed in the end of the shaft.

14. The energy dissipating ball tee as defined by claim 11 wherein the shaft is removably mounted to the base and includes a conical flange at an end thereof opposite the outward end;

wherein the base includes a flat bottom surface;

wherein the base includes a conical recess complementary to the conical flange on the shaft formed through the base and opening into the conical recess for receiving the shaft rearward of the base securing means.

15. The energy dissipating ball tee as defined by claim 11 wherein the base includes an inclined front surface of the base to enable the base to rock forward with the shaft when the shaft is struck by the swinging bat.

16. The energy dissipating ball tee as defined by claim 11 wherein the shaft has a tapered section adjacent its upward end to enable the shaft to bend more uniformly when it is impacted.

17. The energy dissipating ball tee as defined by claim 11 wherein the material forming the shaft and base includes a density of less than 10 pounds per cubic foot.

* * * * *